United States Patent [19]

Mattingly

[11] 4,413,875

[45] Nov. 8, 1983

[54] CONNECTOR RETAINING APPARATUS

[75] Inventor: William R. Mattingly, Santa Ana, Calif.

[73] Assignee: Matrix Science Corporation, Torrance, Calif.

[21] Appl. No.: 304,738

[22] Filed: Sep. 23, 1981

[51] Int. Cl.[3] ..... H01R 13/508

[52] U.S. Cl. ..... 339/217 R

[58] Field of Search ..... 339/140, 217 S, 206 R, 339/213 R, 212, 176 R, 176 M, 217 R, 89 R, 89 C, 89 M, 90 C, 90 R

[56] References Cited

U.S. PATENT DOCUMENTS 2,982,937 5/1961 Gregoire et al. ..... 339/89 C 3,079,582 2/1963 Lazar ..... 339/217 S

*Primary Examiner*—Eugene F. Desmond

*Assistant Examiner*—David Pirlot

*Attorney, Agent, or Firm*—Nilsson, Robbins, Dalgarn, Berliner, Carson & Wurst

[57] ABSTRACT

A connector retaining apparatus for retaining an insulator in the bore of a connector shell includes an insulator with an annular flange defining a rear facing shoulder, a connector shell having an interior cylindrical surface with an annular groove therein to define a front facing retention shoulder, and an annular retaining ring around the insulator. The retaining ring has a radial portion which abuts against the rear facing shoulder of the insulator annular flange and a frusto-conical portion with a retention edge which abuts against the front facing retaining shoulder of the connector shell groove in its retaining position to prevent the insulator from being withdrawn rearwardly from the connector shell bore. A cylindrical insertion tool is utilized to press the retention ring through an annular space between the insulator's outside surface and the connector shell's inside surface into its retaining position.

14 Claims, 5 Drawing Figures

CONNECTOR RETAINING APPARATUS

BACKGROUND OF THE INVENTION

The present invention relates to electrical connectors and more particularly relates to a retaining ring and connector assembly configuration for permanently retaining an insulator insert in a pin or receptacle shell.

The utilization of connectors to interconnect one multiwire cable to another presents a number of problems particularly when those cables are used in aircraft or other systems subject to extreme environmental or operating conditions. Of particular importance is the need to maintain a seal at the interface between the opposing faces of the pin and receptacle connectors to prevent shorting between leads due to conductive contaminants. Additionally, the connector must be constructed so that the insulator inserted in the pin or receptacle shell bore does not break loose from the shell due to the heavy weight of the cable applied against that insulator insert.

Heretofore, many types of retention mechanisms have been tried in an attempt to prevent an insulator from becoming dislodged from a connector shell after long periods of vibration and pulling due to the weight of the cable. However, dislodging of the insulator from the shell still occurs, thereby allowing contamination to enter the interface between the receptacle and the pin connectors which in turn can cause shorting between adjacent conductors of the connector apparatus.

To solve these problems, the present invention comprises a connector retaining apparatus which not only interconnects the insulator insert to the connector shell but also presses the insulator insert firmly against the shoulder of the connector shell to assure that critical interface sealing will be maintained. The connector retaining apparatus also has sufficient flex to accommodate variations in the dimensions of the insulator insert and the connector shell. Finally, because of the configuration of the retaining ring in accordance with the invention, the locking groove can be very shallow so that the strength of the connector shell is not affected in any significant way.

SUMMARY OF THE INVENTION

A connector retaining apparatus in accordance with the invention provides a means whereby an insulator insert can be retained in the bore of a connector shell and includes an insulator insert, a connector shell and a retaining ring. The insulator insert is a generally cylindrical member with an annular flange extending outwardly from its exterior surface. The junction between the annular flange and the exterior surface defines a rear shoulder and a front shoulder each extending generally radially from the exterior surface. The shell has an interior surface defining a centrally disposed bore into which the insulator insert is inserted. The interior surface of the shell has at least one inwardly extending flange which defines a stop shoulder at an end region of the interior surface. Thus, the stop shoulder is positioned for abutting the front shoulder of the insulator to limit the distance of the axial insertion of the insulator into the shell bore. The interior surface further has an annular groove therein at a location rearward of the stop shoulder. The rearmost junction between the annular groove and the interior surface defines a forward facing retaining shoulder which is located rearward of the rear shoulder of the insulator when the front shoulder of the insulator abuts against the stop shoulder of the shell.

The retaining ring has a radial flange portion with an annular interior edge which defines an orifice through the center of the retaining ring. The retaining ring further includes a frusto-conical portion which extends away from the rear shoulder of the insulator and terminates in a retention edge. When the retaining ring is in place, it is positioned around the insulator in the space between the exterior surface of the insulator and the interior surface of the shell so that the retention edge abuts against the retaining shoulder of the shell at the same time that the radial flange abuts against the rear shoulder of the insulator. The insulator is thereby prevented from rearward axial removal from the shell bore by the retaining ring and is prevented from forward withdrawal from the shell by the abutment of the front shoulder of the insulator and the stop shoulder of the shell.

In accordance with one embodiment of the invention, the stop shoulder of the shell and the front shoulder of the insulator may be eliminated or otherwise modified so that the insulator can be removed from the shell by forward axial movement. However, the retaining ring will still prevent the rearward withdrawal of the insulator from the bore of the shell.

In a further embodiment of the invention, the connector retaining apparatus includes an insertion tool for pressing the retention ring along the space between the shell and the insulator. The insertion tool comprises generally a hollow cylindrical member having an outside diameter which is less than the diameter of the shell bore and an inside diameter which is greater than the diameter of the insulator so that the insertion tool can be inserted into the annular space between the interior surface of the shell and the exterior surface of the insulator. The insertion tool has a rounded forward edge which is positioned for being pressed against the retention ring at a location on the insulator facing surface of the frusto-conical portion which location is spaced from the retention edge. By pressing the insertion tool against the central location on the insulator facing surface of the frusto-conical portion, the retaining ring is resiliently deformed in a radially outwardly direction at the central location and the frusto-conical portion is radially deformed inwardly at the retention edge when the retention ring is inserted and pushed along the space between the interior surface of the shell and exterior surface of the insulator.

BRIEF DESCRIPTION OF THE DRAWINGS

A complete understanding of the present invention and of the above and other advantages thereof may be gained from a consideration of the following description of the preferred embodiments taken in conjunction with the accompanying drawings in which.

DETAILED DESCRIPTION

Figure 1:
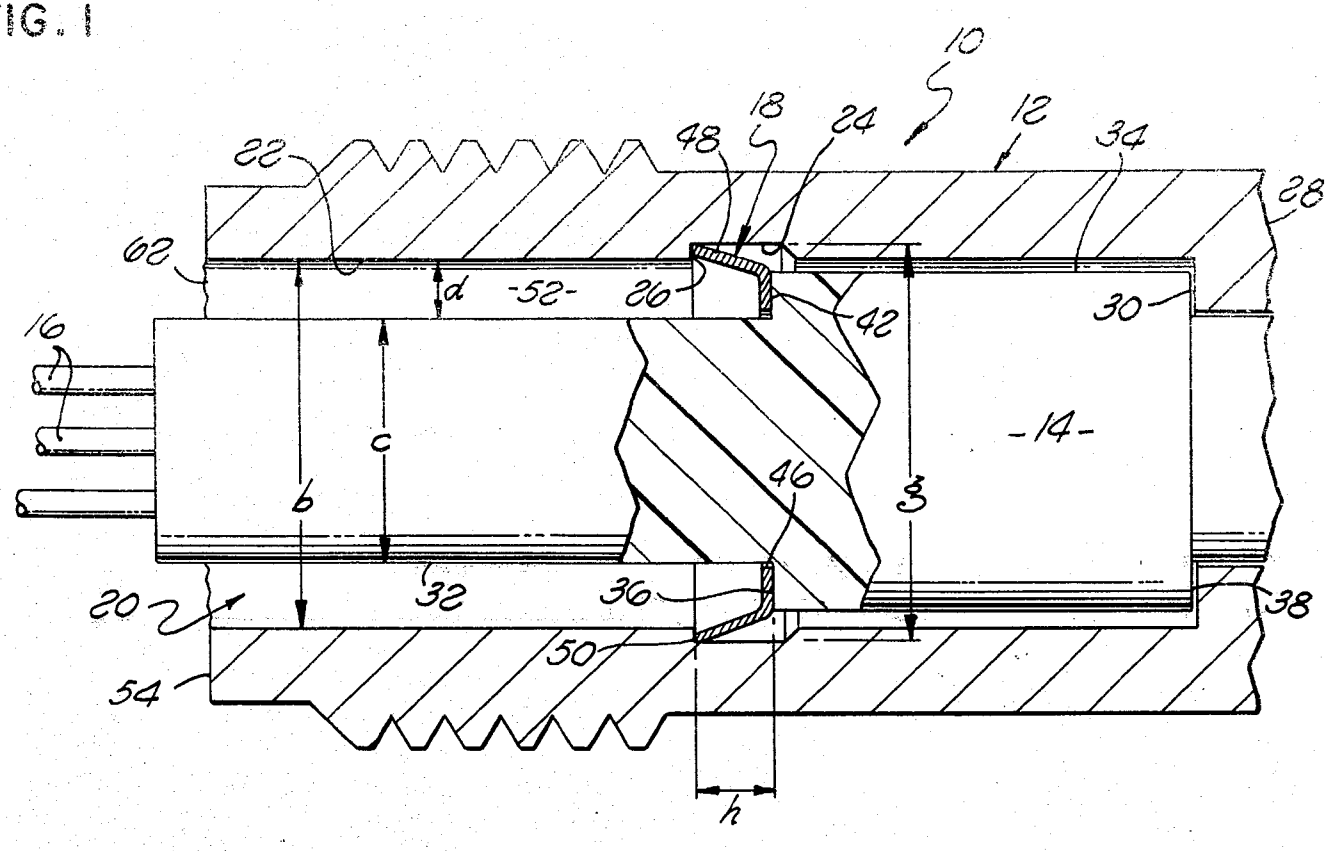
FIG. 1 is a cross-sectional side view of the connector retaining apparatus with the retaining ring in position to retain the insulator in the bore of the shell.

Referring to FIG. 1, a connector retaining apparatus 10 in accordance with the invention includes a connector shell 12 which may be either a receptacle or a pin connector shell, an insulator 14 which typically has a plurality of conductors 16 extending therethrough, and a retaining ring 18 which is positioned to prevent the insulator 14 from being withdrawn rearwardly, i.e., in an axial direction away from the interface between the pin and receptacle connectors. The shell 12 has a bore 20 bounded by an interior surface 22. An annular interior groove 24 is disposed about the interior surface 22 at a central position with the rearmost junction between the interior surface 22 and the interior groove 24 defining a radially extending retaining shoulder 26. An annular flange 28 extends inwardly from the interior surface 22 at a location forward of the interior groove 24 to define a rearward facing stop shoulder 30.

The shell 12 may be made out of any suitable material which is rigid and may, for example, be made out of stainless stell, brass or the like or in some applications may be made out of a rigid plastic material without departing from the spirit of the present invention.

The insulator 14 comprises a cylindrical member made out of a plastic or other nonconductive material and has disposed therethrough a plurality of bores (not shown) for receiving the conductors 16. The insulator 14 has a generally cylindrical exterior surface 32 with a centrally disposed annular flange portion 34 extending radially outwardly therefrom. The rearmost junction between the flange 34 and the exterior surface 32 defines a rear shoulder 36 which extends radially outwardly from the insulator 14 in a direction generally perpendicular to the exterior surface 32. The forwardmost junction between the exterior surface 32 and the annular flange 34 defines a front shoulder 38 which similarly extends radially outwardly from the insulator 14 in a direction substantially perpendicular to the exterior surface 32.

Of course, the rear shoulder 36 and the front shoulder 38 may have a configuration other than a flat, radially disposed annular surface. Nevertheless, the front shoulder 38 should have a configuration which mates with the stop shoulder 30 of the shell 12 to prevent forward movement of the insulator 14.

Figure 2:
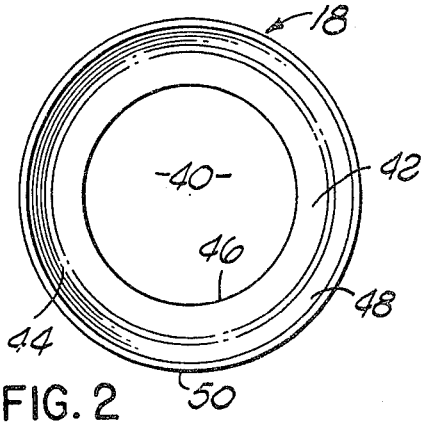
FIG. 2 is a front plan view of the retaining ring in accordance with the invention.
Figure 3:
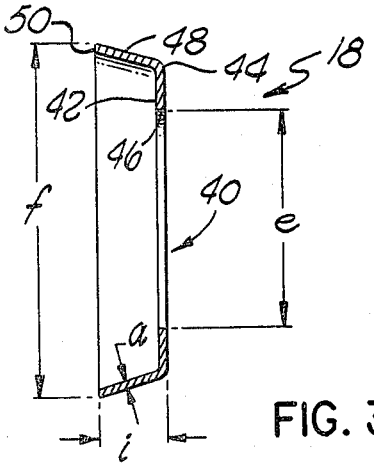
FIG. 3 is a side, cross-sectional, view of the retaining ring in accordance with the invention.

Referring to FIG. 1 in conjunction with FIGS. 2 and 3, the retaining ring 18 is a generally dish-shaped member having a central circuit aperature 40 therethrough. The dish-shaped retaining ring has a radial flange portion 42 extending inwardly from a corner region 44 and terminating at an annular interior edge 46 defining the bounds of the aperature 40. The annular retaining ring also includes a frusto-conical portion 48 which extends from the corner region 44 and terminates at a retention edge 50. The retention edge 50 is axially displaced from the radial flange portion 42 with the diameter of the retaining ring 18 at the retention edge 50 being larger than the diameter of the retaining ring at the corner portion 44. The diameter of the frusto-conical portion 48 of the retaining ring thus increases from the corner region 44 toward the retaining edge 50.

The retaining ring 18 is resiliently deformable to decrease the diameter of the retaining ring at the retention edge 50. One suitable material out of which the retaining ring may be made to allow such resilient deformation is beryllium copper. However, various metals, plastics or any other resiliently bendable material may also be used. In one specific embodiment, the thickness "a" of a beryllium copper retaining ring is in the range of about 0.006 to 0.008 inch.

Referring again to FIG. 1, the bore 20 at the interior surface 22 of the shell 12 has a diameter "b" and the insulator 14 adjacent the exterior surface 32 has a diameter "c" so that there is an annular space 52 between the exterior surface 32 of the insulator 14 and the interior surface 22 of the shell 12. The thickness "d" of the annular space 52 is thus equal to one-half of the difference between the diameter "b" of the bore 20 and the diameter "c" of the insulator 14.

Referring to FIG. 3, the diameter "e" of the aperature 40 of the retaining ring 18 is somewhat larger than the diameter "c" of the insulator 14 so that the retaining ring 18 can be inserted over the insulator 14 with the edge 46 of the retaining ring 18 facing the exterior surface 32 of the insulator 14. The maximum diameter "f" of the retaining ring 18, which is the diameter of the retaining ring 18 at the retention edge 50, is then selected to be larger than the diameter "b" of the bore 20. In addition, the maximum diameter "f" of the retention ring 18 is also provided in the preferred embodiment to be larger than the diameter "g" of the interior groove 24 so that the retention edge 50 will press against both the retaining shoulder 26 and the annular surface of the interior groove 24 when the retaining ring 18 is in the operable retaining position. Finally, the dimensions of the flange 34 of the insulator 14 and the flange 28 of the shell 12 are selected so that when the insulator 14 is inserted into the bore 20 from the rear end 54 of the connector retaining apparatus 10, the front shoulder 38 will abut against the stop shoulder 30 to prevent axial movement of the insulator 14 into the bore 20 beyond a predefined depth. In accordance with the invention, when the front shoulder 38 is abutting against the stop shoulder 30, the rear shoulder 36 will be spaced axially from the retaining shoulder 26 by a distance "h". The axial thickness "i" of the retaining ring 18 is then selected in the preferred embodiment to be equal to or slightly greater than the distance "h" between the rear shoulder 36 and the retaining shoulder 26. Because of the resiliency of the retaining ring 18, the distance "h" may vary within a tolerance value.

Figure 4:
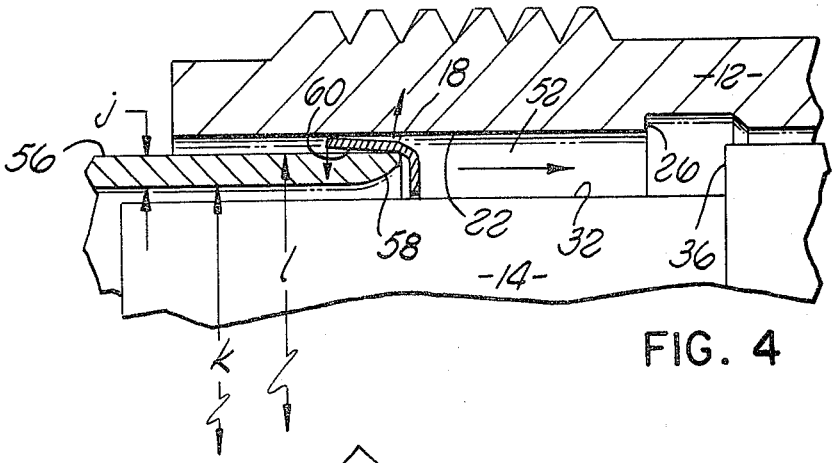
FIG. 4 is a partial cross-sectional view of the connector retaining apparatus illustrating the utilization of an insertion tool to press the retaining ring along the space between the interior surface of the shell and exterior surface of the insulator.
Figure 5:
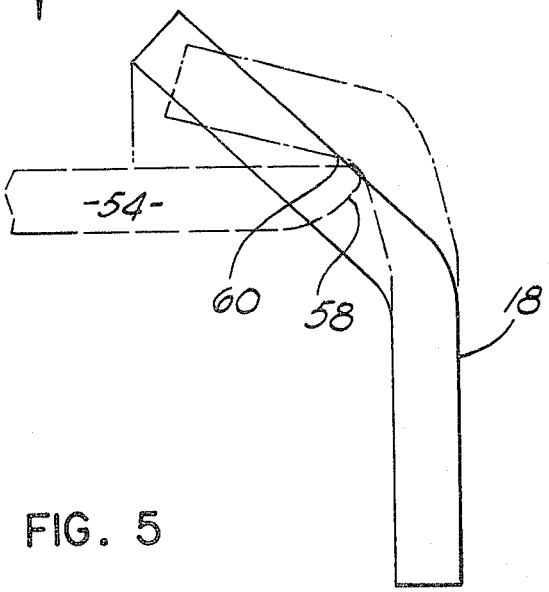
FIG. 5 is a partial cross-sectional side view of a retaining ring which illustrates the resilient deformation of the frusto-conical portion of the retaining ring when it is pressed into place by the insertion tool.

Referring to FIG. 1 in conjunction with FIGS. 4 and 5, after the insulator 14 is inserted into the bore 20 so that the front shoulder 38 abuts against the stop shoulder 30, the retaining ring 18 is positioned around the insulator 14 adjacent the rear facing opening of the bore 20. The retaining ring 18 is then pressed into the space 52 between the exterior surface 32 of the insulator 14 and the interior surface 22 of the shell 12 utilizing a suitable insertion tool 56. The insertion tool 56 in accordance with the invention is a tube-like cylindrical structure having a wall thickness "j" which is less than the thickness "d" of the space 52. The diameter "k" of the bore through the cylindrical insertion tool 54 is larger than the diameter "c" of the insulator 14 and the outside diameter "l" of the cylindrical insertion tool is smaller than the diameter "b" of the bore 20. Such a dimensional relationship allows the cylindrical insertion tool 56 to be positioned around the insulator 14 and thereafter inserted axially into the space 52. The insertion tool 56 is then provided with a generally rounded forward edge 58 which is positioned to contact the insulator facing surface 60 of the frusto-conical portion for pushing the retaining ring into and along the space 52 until the radial portion 42 of the retaining ring 18 abuts against the rear shoulder 36 of the insulator 14. Thereafter continued pressing of the retaining ring will cause the edge 50 to snap into abutting position against the retaining shoulder 26. In accordance with the preferred embodiment of the invention the radial width of the retaining shoulder 26 is equal to or slightly larger than the thickness of the retaining ring 18.

Referring to FIG. 5, it will be appreciated that if the retaining ring axial width "i" is greater than the distance "h" between the rear shoulder 36 and the retaining shoulder 26, that the insertion tool 54 will press at the interior central region 60 along the frusto-conical portion of the retaining ring to thereby resiliently decrease the width "i" of the retaining ring 18 to allow the retention edge 50 to move radially outward to contact the retaining shoulder 26 even after movement of the retaining ring would otherwise have been stopped by the abutment of the radial portion 42 of the retaining ring 18 against the shoulder 36 of the insulator 14. This allows for variations in the width "h" between the rear shoulder 36 and the retaining shoulder 26 without affecting the ability of a retaining ring 18 to perform its retaining function between the insulator 14 and the shell 12. Once the retaining ring 18 is in place, the space 52 may be filled with a suitable epoxy or adhesive 62 to further bind the insulator 14 to the shell 12.

While various embodiments of the invention have been heretofore described, it will be appreciated that those embodiments are illustrative only and that various changes and alterations may be made in the invention without departing from its essential aspects.

What is claimed is:

1. A connector retaining apparatus for retaining an insulator insert in a shell comprising:

an insulator insert comprising:

an exterior surface, an annular flange extending radially outwardly from the exterior surface to define a rear facing shoulder at a junction between the annular flange and the exterior surface, and a front facing front shoulder;

a connector shell having an interior surface defining a centrally disposed bore for receiving the insulator insert, the interior surface having at least one rear facing stop shoulder extending radially inwardly therefrom, the stop shoulder positioned for abutting the front shoulder of the insulator insert when the insulator insert is inserted into the bore of the connector shell, the interior surface further having an annular groove disposed therein at a location rearward of the stop shoulder, the rearmost junction between the annular groove and the interior surface defining a front facing retaining shoulder, the retaining shoulder being located rearward of the rear facing shoulder of the insulator insert when the front shoulder of the insulator insert abuts against the stop shoulder of the connector shell; and a retaining ring comprising:

a radial flange portion having an annular interior edge defining an orifice through the retaining ring, the radial flange portion abutting against the rear facing shoulder of the insulator insert, and a frusto-conical portion extending rearwardly from the rear facing shoulder of the insulator insert and having a retention edge for abutting against the retaining shoulder of the connector shell whereby the insulator insert is prevented from rearward axial removal from the connector shell bore by the retaining ring between the retaining shoulder of the connector shell and the rear facing shoulder of the insulator insert, and the insulator insert is prevented from forward axial removal from the connector shell bore by the abutment of the front shoulder of the insulator insert against the stop shoulder of the connector shell.

2. The connector retaining apparatus of claim 1 wherein the retaining ring frusto-conical portion is resiliently deformable in a generally radial direction.

3. The connector retaining apparatus of claim 1 wherein the connector shell bore defined by the interior surface has a first diameter, the insulator insert portion defined by the exterior surface has a second diameter, the retaining ring orifice having a third diameter larger than the second diameter and the retaining ring having a maximum diameter greater than the first diameter, the retaining ring being insertable around the insulator insert between the insulator exterior surface and the connector shell interior surface whereby the frusto-conical position is resiliently deformed upon insertion between the connector shell and the insulator insert so that the maximum diameter of the retaining ring resiliently decreases to be substantially equal to the first diameter until the retaining ring is inserted a sufficient distance so that the retention edge is adjacent the retaining shoulder of the connector shell whereupon the maximum diameter increases to position the retention edge against the retaining shoulder.

4. The connector retaining apparatus of claim 1 or 3 wherein the retaining ring is made from beryllium copper.

5. The connector retaining apparatus of claim 3 wherein the frusto-conical portion has an insulator insert facing surface, the connector retaining apparatus further comprising an insertion tool for pressing the retaining ring between the connector shell and the insulator insert, the insertion tool comprising a cylindrical tube member having an outside diameter less than the first diameter and an inside diameter greater than the second diameter whereby the cylindrical tube member is insertable between the interior surface of the connector shell and exterior surface of the insulator insert, the cylindrical tube member having a rounded forward edge for being pressed against the insulator insert facing surface of the frusto-conical portion at a location spaced from the retention edge for resiliently deforming the frusto-conical portion radially outwardly at said location and resiliently deforming the frusto-conical portion radially inward at the retention edge when the retaining ring is inserted.

6. A retaining ring for preventing rearward axial withdrawal of an insulator insert from a connector shell wherein the insulator insert has an external cylindrical surface with a rear facing shoulder extending radially therefrom and the shell has an internal cylindrical surface with a groove therein to define a front facing annular shoulder extending radially outwardly from the internal surface, the retaining ring comprising:

an annular corner section;

a radial flange section extending inwardly from the corner section and terminating at an annular inner edge; and a frusto-conical section extending from the corner section and terminating in a retention edge, the frusto-conical section having a diameter which progressively increases from the corner section toward the retention edge, the retaining ring having dimensions selected so that the radial flange abuts against the rear facing shoulder, and the frusto-conical section extends into the connector shell groove with the retention edge abutting the front facing annular shoulder to prevent rearward axial withdrawal of the insulator insert from the connector shell.

7. The retaining ring of claim 6 wherein the frusto-conical section is resiliently deformable in a generally radial direction.

8. The retaining ring of claim 6 or 7 wherein the retaining ring is made from beryllium copper.

9. A connector apparatus for preventing axial withdrawal of an insulator insert from a connector shell in at least one axial direction comprising:

an insulator insert having an exterior surface with an annular flange extending outwardly therefrom, the junction between the exterior surface and the annular flange defining a radially disposed, rear-facing shoulder;

a connector shell having a bore for receiving the insulator insert therein, the bore bounded by an interior surface of the connector shell, the interior surface having a circumferentially disposed groove therein for defining a front-facing stop shoulder between the interior surface and the groove; and a generally circular retaining member for being positioned around the exterior surface of the insulator insert, the retaining member comprising:

an annular corner section;

a radial flange section having an inner edge, the radial flange section extending radially inwardly from the corner section and terminating at its inner edge; and a frusto-conical section having a retention edge, the frusto-conical section extending from the corner section and terminating at the retention edge, the retaining member having dimensions selected so that the radial flange portion abuts against the rear shoulder of the insulator insert and the retention edge abuts against the stop shoulder of the connector shell to prevent withdrawal of the insulator insert from the connector shell in the at least one axial direction.

10. The connector retaining apparatus of claim 9 wherein the retaining ring frusto-conical section is resiliently deformable in a generally radial direction.

11. The connector retaining apparatus of claim 9 wherein the connector shell bore defined by the interior surface has a first diameter, the insulator insert portion defined by the exterior surface has a second diameter, the retaining member orifice having a third diameter larger than the second diameter and the retaining member having a maximum diameter greater than the first diameter, the retaining member being insertable around the insulator insert between the insulator exterior surface and the connector shell interior surface whereby the frusto-conical section is resiliently deformed upon insertion between the connector shell and the insulator insert so that the maximum diameter of the retaining member resiliently decreases to be substantially equal to the first diameter until the retaining member is inserted a sufficient distance so that the retention edge is adjacent the retaining shoulder of the connector shell whereupon the maximum diameter increases to position the retention edge against the retaining shoulder.

12. The connector retaining apparatus of claim 9 or 11 wherein the retaining ring is made from beryllium copper.

13. The connector retaining apparatus of claim 11 wherein the frusto-conical section has an insulator insert facing surface, the connector retaining apparatus further comprising an insertion tool for pressing the retaining member between the connector shell and the insulator insert, the insertion tool comprising a cylindrical tube member having an outside diameter less than the first diameter and an inside diameter greater than the second diameter whereby the cylindrical tube member is insertable between the interior surface of the connector shell and exterior surface of the insulator insert, the cylindrical tube member having a rounded forward edge for being pressed against the insulator insert facing surface of the frusto-conical section at a location spaced from the retention edge for resiliently deforming the frusto-conical section radially outwardly at said location and resiliently deforming the frusto-conical section radially inward at the retention edge when the retaining member is inserted.

14. The connector retaining apparatus of claim 9 wherein the retaining member has a first thickness where the radial width of the stop shoulder is greater than the first thickness.

* * * * *